US011003104B2

(12) United States Patent
Katsura et al.

(10) Patent No.: US 11,003,104 B2
(45) Date of Patent: May 11, 2021

(54) TONER

(71) Applicant: CANON KABUSHIKI KAISHA, Tokyo (JP)

(72) Inventors: Taiji Katsura, Suntou-gun (JP); Masamichi Sato, Mishima (JP); Shohei Kototani, Suntou-gun (JP); Kentaro Yamawaki, Mishima (JP); Tsuneyoshi Tominaga, Suntou-gun (JP); Masatake Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,101

(22) Filed: Dec. 27, 2019

(65) Prior Publication Data

US 2020/0209774 A1 Jul. 2, 2020

(30) Foreign Application Priority Data

Dec. 28, 2018 (JP) ..... JP2018-247079

(51) Int. Cl.
*G03G 9/097* (2006.01)

(52) U.S. Cl.
CPC ..... *G03G 9/09716* (2013.01); *G03G 9/09708* (2013.01); *G03G 9/09775* (2013.01)

(58) Field of Classification Search
None
See application file for complete search history.

(56) References Cited

U.S. PATENT DOCUMENTS

| | | | | |
|---|---|---|---|---|
| 5,244,764 | A * | 9/1993 | Uno | G03G 9/09783 430/108.1 |
| 7,833,685 | B2 | 11/2010 | Tanaka et al. | |
| 8,372,573 | B2 | 2/2013 | Ayaki et al. | |
| 8,377,616 | B2 | 2/2013 | Tani et al. | |
| 8,383,313 | B2 | 2/2013 | Ayaki et al. | |
| 8,551,680 | B2 | 10/2013 | Ayaki et al. | |
| 8,628,899 | B2 | 1/2014 | Kawamura et al. | |
| 8,815,484 | B2 | 8/2014 | Tanaka et al. | |
| 9,158,216 | B2 | 10/2015 | Shimano et al. | |
| 9,341,967 | B2 | 5/2016 | Tsujino et al. | |
| 9,366,981 | B2 | 6/2016 | Yamawaki et al. | |
| 9,377,705 | B2 | 6/2016 | Shimano et al. | |
| 9,383,668 | B2 | 7/2016 | Noji et al. | |
| 9,423,708 | B2 | 8/2016 | Tominaga et al. | |
| 9,500,972 | B2 | 11/2016 | Tanaka et al. | |
| 9,575,424 | B2 | 2/2017 | Nakagawa et al. | |
| 9,599,919 | B2 | 3/2017 | Isono et al. | |
| 9,632,441 | B2 | 4/2017 | Abe et al. | |
| 9,658,549 | B2 | 5/2017 | Tanaka et al. | |
| 9,720,340 | B2 | 8/2017 | Tominaga et al. | |
| 9,733,583 | B2 | 8/2017 | Kuroki et al. | |
| 9,733,584 | B2 | 8/2017 | Masumoto et al. | |
| 9,785,071 | B2 | 10/2017 | Shimano et al. | |
| 9,785,077 | B2 | 10/2017 | Abe et al. | |
| 9,829,816 | B2 | 11/2017 | Tanaka et al. | |
| 9,829,820 | B2 | 11/2017 | Masumoto et al. | |
| 9,835,964 | B2 | 12/2017 | Yoshida et al. | |
| 9,897,932 | B2 | 2/2018 | Hotta et al. | |
| 9,904,193 | B2 | 2/2018 | Nakagawa et al. | |
| 9,921,501 | B2 | 3/2018 | Mochizuki et al. | |
| 9,958,801 | B2 | 5/2018 | Tanaka et al. | |
| 10,054,866 | B2 | 8/2018 | Tanaka et al. | |
| 10,114,303 | B2 | 10/2018 | Katsura et al. | |
| 10,429,757 | B2 | 10/2019 | Yoshida et al. | |
| 10,503,090 | B2 | 12/2019 | Tominaga et al. | |
| 10,545,422 | B2 | 1/2020 | Yamawaki et al. | |
| 2004/0058258 | A1 | 3/2004 | Yoshino et al. | |
| 2004/0137356 | A1 | 7/2004 | Tomita et al. | |
| 2008/0226998 | A1 | 9/2008 | Ishii et al. | |
| 2009/0117477 | A1 | 5/2009 | Magome et al. | |
| 2009/0155706 | A1 | 6/2009 | Shu et al. | |
| 2010/0035171 | A1 | 2/2010 | Watanabe et al. | |
| 2010/0248110 | A1 | 9/2010 | Taguchi et al. | |
| 2012/0295189 | A1* | 11/2012 | Zhu | G03G 9/09725 430/108.3 |
| 2014/0220488 | A1 | 8/2014 | Hosoya et al. | |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/670,352, Kentaro Yamawaki, filed Oct. 31, 2019.
U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.
U.S. Appl. No. 16/728,157, Shohei Kototani, filed Dec. 27, 2019.

(Continued)

*Primary Examiner* — Christopher D Rodee
(74) *Attorney, Agent, or Firm* — Venable LLP

(57) ABSTRACT

Provided is a toner including a toner particle and an external additive, wherein the external additive includes a composite particle including a hydrotalcite particle covered on the surface with an organosilicon polymer fine particle, a coverage ratio of the hydrotalcite particle surface by the organosilicon polymer fine particle is from 1% to 50%, and given A (nm) as the number-average particle diameter of the primary particles of the organosilicon polymer fine particle and B (nm) as the number-average particle diameter of the primary particles of the hydrotalcite particle, the toner satisfies the following formula (I) and formula (II):

$$A<B \quad \text{(I)}$$

$$20 \leq A \leq 350 \quad \text{(II).}$$

6 Claims, No Drawings

(56) References Cited

U.S. PATENT DOCUMENTS

| | | | | |
|---|---|---|---|---|
| 2014/0356779 | A1 | 12/2014 | Hasegawa et al. | |
| 2015/0010652 | A1 | 1/2015 | Kurogi et al. | |
| 2015/0248072 | A1 | 9/2015 | Katsuta et al. | |
| 2016/0187799 | A1 | 6/2016 | Hiroshi et al. | |
| 2016/0299446 | A1 | 10/2016 | Kuroki et al. | |
| 2017/0219947 | A1 | 8/2017 | Omori et al. | |
| 2017/0329246 | A1 | 11/2017 | Yamawaki et al. | |
| 2018/0329323 | A1 | 11/2018 | Kimura et al. | |
| 2018/0329324 | A1 | 11/2018 | Kamikura et al. | |
| 2018/0329327 | A1 | 11/2018 | Yamawaki et al. | |
| 2018/0329329 | A1 | 11/2018 | Nakamura et al. | |
| 2019/0187609 | A1* | 6/2019 | Ikami | G03G 9/0819 |
| 2019/0332024 | A1 | 10/2019 | Umeda et al. | |
| 2020/0026208 | A1 | 1/2020 | Terui et al. | |
| 2020/0026209 | A1 | 1/2020 | Yagi et al. | |
| 2020/0124998 | A1 | 4/2020 | Kototani et al. | |
| 2020/0124999 | A1 | 4/2020 | Tanaka et al. | |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 1198372 | 3/1984 |
| JP | H02-166461 | 6/1990 |
| JP | 4544096 | 9/2010 |
| JP | 5911153 | 4/2016 |
| WO | 2018/003749 | 1/2018 |

OTHER PUBLICATIONS

U.S. Appl. No. 16/728,171, Takaaki Furui, filed Dec. 27, 2019.
U.S. Appl. No. 16/728,179, Koji Nishikawa, filed Dec. 27, 2019.

* cited by examiner

TONER

BACKGROUND OF THE INVENTION

Field of the Invention

The present invention relates to a toner for use in image-forming methods such as electrophotographic methods.

Description of the Related Art

In electrophotographic methods, a latent image bearing member is first charged by various means, and then exposed to light to form an electrostatic latent image on the surface of the latent image bearing member. The electrostatic latent image is then developed with a toner to form a toner image, which is then transferred to a transfer material such as paper. The toner image on the transfer material is then fixed by application of heat, pressure, or heat and pressure to obtain a copied article or print.

When such an image-forming process is repeated multiple times, external additives may melt adhere to the surface of the latent image bearing member, causing black spots on the image. Ozone generated in the step of charging the latent image bearing member may also react with nitrogen in the air to produce nitrogen oxides (NOx).

This nitrogen oxides react with moisture in the air to become nitric acid, which attaches to the surface of the latent image bearing member and reduces the resistance of the latent image bearing member surface. As a result, the latent image on the latent image bearing member is disrupted during image formation, causing image smearing.

Japanese Patent Application Publication No. H02-166461 proposes a technique for eliminating discharge products by externally adding a hydrotalcite compound particle to the toner particle as an acid acceptor.

Japanese Patent No. 4544096 attempts to eliminate discharge products and prevent melt adhesion of external additives by externally adding to the toner particle a resin particle encapsulating a hydrotalcite compound with part of the hydrotalcite compound exposed on the resin particle surface.

SUMMARY OF THE INVENTION

The method described in Japanese Patent Application Publication No. H02-166461 is effective at excluding initial discharge products. However, when the image-forming process is repeated several times, the hydrotalcite compound particle may melt adhere to the surface of the latent image bearing member and cause image defects.

The method described in Japanese Patent No. 4544096 tends to reduce toner flowability because it uses a resin particle with a large particle diameter relative to the hydrotalcite compound. In particular, the exposed part of the hydrotalcite compound tends to protrude, and this part exhibits high local positive chargeability. The cohesive force between toner particles is increased as a result, and flowability tends to decline. This in turn can cause image problems such as a decrease in solid followability.

The present invention provides a toner that resolves these problems.

Specifically, the present invention provides a toner with good flowability whereby image smearing and melt adhesion of external additives to the latent image bearing member can be suppressed even during long-term use.

The inventors discovered as a result of exhaustive research that these problems could be solved with the following toner.

That is, the present invention is a toner having a toner particle and an external additive, wherein the external additive includes a composite particle comprising a hydrotalcite particle covered on the surface with an organosilicon polymer fine particle, the coverage ratio of the hydrotalcite particle surface by the organosilicon polymer fine particle is from 1% to 50%, and given A (nm) as the number-average particle diameter of the primary particles of the organosilicon polymer fine particle and B (nm) as the number-average particle diameter of the primary particles of the hydrotalcite particle, the toner satisfies the following formula (I) and formula (II):

$$A<B \quad \text{(I)}$$

$$20 \leq A \leq 350 \quad \text{(II)}.$$

With the present invention, it is possible to obtain a toner with good flowability whereby image smearing and melt adhesion of external additives to the latent image bearing member can be suppressed even during long-term use.

Further features of the present invention will become apparent from the following description of exemplary embodiments.

DESCRIPTION OF THE EMBODIMENTS

As discussed above, removing acid components derived from discharge products on the latent image bearing member is effective for suppressing image smearing. It is effective to add a hydrotalcite particle to the toner particle as an acid acceptor. However, once it has adsorbed acid the hydrotalcite particle is likely to melt adhere to the latent image bearing member, and image defects such as black spots are likely to occur due to melt adhesion.

The inventors therefore investigated ways to reduce the attachment force of the hydrotalcite particle on the latent image bearing member. Specifically, we investigated covering a specific percentage of the hydrotalcite particle with another material with a lower attachment force to the latent image bearing member.

We then discovered that an organosilicon polymer fine particle is an excellent material with a low attachment force to the latent image bearing member. In general, organosilicon polymer fine particles have excellent properties as release agents, and are thought to be effective for reducing attachment force. By including a composite particle comprising a hydrotalcite particle covered on the surface with an organosilicon polymer fine particle as an external additive, it is possible to obtain a toner whereby image smearing and melt adhesion of the external additive to the latent image bearing member are suppressed even during long-term use.

Hydrotalcite particles also have strong positive charging properties, and have tended to reduce toner flowability when used as external additives in toner particles. This is thought to be because the presence of a hydrotalcite particle with a high charge quantity between toner particles causes the toner particles to aggregate electrostatically.

Such a drop in flowability is especially conspicuous when using a negatively charged toner particle. The inventors discovered that the flowability of the toner is better when a composite particle comprising a hydrotalcite particle covered on the surface with an organosilicon polymer fine particle is added rather than adding a hydrotalcite particle directly. This is thought to be because the positive charge properties of the hydrotalcite particle are weakened by the effect of the organosilicon polymer fine particle covering the hydrotalcite particle, reducing the toner particle aggregation effect.

Thus, the inventors discovered that good flowability could be obtained and image smearing and melt adhesion of the external additive to the latent image bearing member could be suppressed by using a composite particle comprising a hydrotalcite particle covered on the surface with an organosilicon polymer fine particle, thereby arriving at the present invention.

Unless otherwise specified, descriptions of numerical ranges such as "from XX to YY" or "XX to YY" in the present invention include the numbers at the upper and lower limits of the range.

Specifically, the present invention is a toner having a toner particle and an external additive, wherein the external additive includes a composite particle comprising a hydrotalcite particle covered on the surface with an organosilicon polymer fine particle, the coverage ratio of the hydrotalcite particle surface by the organosilicon polymer fine particle is from 1% to 50%, and given A (nm) as the number-average particle diameter of the primary particles of the organosilicon polymer fine particle and B (nm) as the number-average particle diameter of the primary particles of the hydrotalcite particle, the toner satisfies the following formula (I) and formula (II):

$$A<B \quad \text{(I)}$$

$$20 \leq A \leq 350 \quad \text{(II)}.$$

The present invention is explained in detail below.

The toner has a toner particle and an external additive, and the external additive includes a composite particle comprising a hydrotalcite particle covered on the surface with an organosilicon polymer fine particle.

For the hydrotalcite particle to be covered on the surface with the organosilicon polymer fine particle means that the organosilicon polymer fine particle is attached to the surface of the hydrotalcite particle.

The toner can be observed with an electron microscope or the like to confirm whether or not the organosilicon polymer fine particle is attached.

The coverage ratio of the hydrotalcite particle surface by the organosilicon polymer fine particle is from 1% to 50%.

If the coverage ratio is less than 1%, the melt adhesion prevention effect of the organosilicon polymer fine particle is not obtained. If it exceeds 50%, on the other hand, the effect of the hydrotalcite particle as an acid acceptor is inhibited, and a sufficient effect on image smearing is not obtained.

Specific methods for measuring the coverage ratio are described below.

Given A (nm) as the number-average particle diameter of the primary particles of the organosilicon polymer fine particle and B (nm) as the number-average particle diameter of the primary particles of the hydrotalcite particle, the toner satisfies the following formula (I) and formula (II):

$$A<B \quad \text{(I)}$$

$$20 \leq A \leq 350 \quad \text{(II)}.$$

The formula (I) shows that the number-average particle diameter of the primary particles of the hydrotalcite particle is larger than the number-average particle diameter of the primary particles of the organosilicon polymer fine particle.

To cover the hydrotalcite particle surface with the organosilicon polymer fine particle and obtain a coverage ratio of the hydrotalcite particle surface by the organosilicon polymer fine particle within the above range, it is necessary to use an organosilicon polymer fine particle with a smaller particle diameter than the hydrotalcite particle.

The formula (II) shows that the number-average particle diameter A (nm) of the primary particles of the organosilicon polymer fine particle is from 20 to 350. If the number-average particle diameter of the primary particles of the organosilicon polymer fine particle is within the above range, the above effects can be obtained without reducing the flowability of the toner.

A (nm) is preferably from 20 to 300, or more preferably from 50 to 250.

Moreover, the ratio of A to B (A/B) is preferably from 0.01 to 0.50, or more preferably from 0.05 to 0.30.

The composition of the organosilicon polymer fine particle is not particularly limited, but a fine particle of the following composition is preferred.

The organosilicon polymer fine particle has a structure of alternately bonded silicon atoms and oxygen atoms, and part of the organosilicon polymer preferably has a T3 unit structure represented by $R^aSiO_{3/2}$. $R^a$ is preferably a hydrocarbon group, and more preferably a $C_{1-6}$ (preferably $C_{1-3}$, more preferably $C_{1-2}$) alkyl group or phenyl group.

In $^{29}$Si-NMR measurement of the organosilicon polymer fine particle, moreover, a ratio of an area of a peak derived from silicon having the T3 unit structure relative to a total area of peaks derived from all silicon elements contained in the organosilicon polymer fine particle is preferably from 0.50 to 1.00, or more preferably from 0.90 to 1.00.

The method of manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid, nitric acid and the like, and basic catalysts such as ammonia water, sodium hydroxide, potassium hydroxide and the like.

The organosilicon compound for producing the organosilicon polymer fine particle is explained below.

The organosilicon polymer is preferably a polycondensate of an organosilicon compound having a structure represented by the following formula (Z):

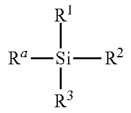

(Z)

In formula (Z), $R^a$ represents an organic functional group, and each of $R^2$ and $R^3$ independently represents a halogen atom, hydroxyl group or acetoxy group, or a (preferably $C_{1-3}$) alkoxy group.

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^2$ and $R^3$ can be controlled by means of the reaction temperature, reaction time, reaction solvent and pH. An organosilicon compound having three reactive groups ($R^1$, $R^2$ and $R^3$) in the molecule apart from $R^a$ as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

The hydrotalcite particle may be one represented by the following structural formula (5):

$$M^{2+}_{y}M^{3+}_{x}(OH)_2A^{n-}_{(x/n)}.mH_2O \quad \text{formula (5)}$$

in which $M^{2+}$ and $M^{3+}$ represent bivalent and trivalent metals, respectively.

The hydrotalcite particle may also be a solid solution containing multiple different elements. It may also contain a trace amount of a monovalent metal.

However, preferably $0<x\leq 0.5$, $y=1-x$, and $m\geq 0$.

$M^{2+}$ is preferably at least one bivalent metal ion selected from the group consisting of Mg, Zn, Ca, Ba, Ni, Sr, Cu and Fe.

$M^{3+}$ is preferably at least one trivalent metal ion selected from the group consisting of Al, B, Ga, Fe, Co and In.

$A^{n-}$ is an n-valent anion, examples of which include $CO_3^{2-}$, $OH^-$, $Cl^-$, $I^-$, $F^-$, $Br^-$, $SO_4^{2-}$, $HCO_3^{2-}$, $CH_3COO^-$ and $NO_3^-$, and one or multiple kinds may be present.

Specific examples include $Mg_{4.3}Al_2(OH)_{12.6}CO_3.mH_2O$, $Mg_6Al_2(OH)_{16}CO_3.mH_2O$ and the like.

Magnesium is preferred as the bivalent metal ion $M^{2+}$ above, and aluminum is preferred as the trivalent metal ion $M^{3+}$ above.

The hydrotalcite particle also preferably contains water in the molecule, and more preferably $0.1<m<0.6$ in the formula (5).

The number-average particle diameter B (nm) of the primary particles of the hydrotalcite particle is preferably from 60 to 1,000, or more preferably from 200 to 800.

If B (nm) is less than 60, it becomes more difficult to control the coverage ratio within the above range when the particle is covered with the organosilicon polymer fine particle. On the contrary, if B (nm) is more than 1000, fluidity of the toner tends to be easily lowered.

From the standpoint of environmental stability, it is desirable to hydrophobically treat the hydrotalcite particle with a surface treatment agent. A higher fatty acid, coupling agent or ester or an oil such as silicone oil may be used as the surface treatment agent. Of these, a higher fatty acid may be used by preference, and specific examples include stearic acid, oleic acid and lauric acid.

There are no particular limitations on the method by which the composite particle comprising the hydrotalcite particle covered on the surface with the organosilicon polymer fine particle is added as an external additive to the toner particle.

For example, one method is to form the composite particle in advance by mixing and stirring the organosilicon polymer fine particle and hydrotalcite particle prior to external addition to the toner particle, and then externally add the resulting composite particle to the toner particle.

The mixer for pre-mixing may be for example an FM mixer (Nippon Coke & Engineering Co., Ltd.), super mixer (Kawata Mfg. Co., Ltd.), Nobilta (Hosokawa Micron Corporation), hybridizer (Nara Machinery Co., Ltd.) or the like. In addition to the composite particle, the organosilicon polymer fine particle and hydrotalcite particle may also each be present independently on the toner particle.

The number ratio of the composite particle relative to the toner particle is not particularly limited, but is preferably at least 0.001, or more preferably at least 0.005. If the number ratio of the composite particle is too large relative to the toner particle, toner fluidity tends to decline, so it is preferably not more than 1.000. These numerical ranges may be combined at will.

The content of the composite particle is not particularly limited, but is preferably 0.01 to 3.00 mass parts, or more preferably 0.10 to 1.00 mass parts per 100 mass parts of the toner particle.

Another external additive may also be included in the toner in order to improve toner performance.

In this case, the total amount of inorganic and organic fine particles including the composite particle is preferably 0.50 to 5.00 mass % per 100 mass parts of the toner particle.

If the total amount of fine particles is within this range, toner fluidity is further improved, and contamination of the members by external additives can be further suppressed. Examples of these inorganic and organic fine particles include known particles used in toners.

The mixer for adding the external additives to the toner particle is not particularly limited, and a known dry or wet mixer may be used. Examples include the FM mixer (Nippon Coke & Engineering Co., Ltd.), super mixer (Kawata Mfg. Co., Ltd.), Nobilta (Hosokawa Micron Corporation), hybridizer (Nara Machinery Co., Ltd.) and the like.

The sieving apparatus used to separate out coarse particles after external addition may be an Ultrasonic (Koei Sangyo Co., Ltd.); Resona Sieve or Gyro-Sifter (Tokuju Co., Ltd.); Vibrasonic System (Dalton Corporation); Soniclean (Sintokogio, Ltd.); Turbo Screener (Freund-Turbo Corporation); Microsifter (Makino Mfg. Co., Ltd.) or the like.

The method for manufacturing the toner particle is explained here.

A known method may be used as the toner particle manufacturing method, such as a kneading pulverization method or wet manufacturing method. A wet manufacturing method is preferred from the standpoint of shape control and obtaining a uniform particle diameter. Examples of wet manufacturing methods include suspension polymerization methods, solution suspension methods, emulsion polymerization-aggregation methods, emulsion aggregation methods and the like, and an emulsion aggregation method is preferred.

In emulsion aggregation methods, materials such as a binder resin fine particle, a colorant fine particle and the like are dispersed and mixed in an aqueous medium containing a dispersion stabilizer. A surfactant may also be added to the aqueous medium. A flocculant is then added to aggregate the mixture until the desired toner particle size is reached, and the resin fine particles are also fused together either after or during aggregation. Shape control with heat may also be performed as necessary in this method to form a toner particle.

The binder resin fine particle here may be a composite particle formed as a multilayer particle comprising two or more layers composed of resins with different compositions. This can be manufactured for example by an emulsion polymerization method, mini-emulsion polymerization method, phase inversion emulsion method or the like, or by a combination of multiple manufacturing methods.

When the toner particle contains an internal additive such as a colorant, the internal additive may be included originally in the resin fine particle, or a liquid dispersion of an internal additive fine particle consisting only of the internal additive may be prepared separately, and the internal additive fine particles may then be aggregated together when the resin fine particles are aggregated.

Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins. These binder resins may be used individually or mixed together.

The binder resin preferably contains carboxyl groups, and is preferably a resin manufactured using a polymerizable monomer containing a carboxyl group. Examples include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 to 15.000 mass parts per 100 mass parts of the polymerizable monomers.

A release agent is preferably included as one of the materials constituting the toner. In particular, a plasticization effect is easily obtained using an ester wax with a melting point of from 60° C. to 90° C. because the wax is highly compatible with the binder resin.

Examples of the ester wax include waxes having fatty acid esters as principal components, such as carnauba wax and montanic acid ester wax; those obtained by deoxidizing part or all of the oxygen component from the fatty acid ester, such as deoxidized carnauba wax; hydroxyl group-containing methyl ester compounds obtained by hydrogenation or the like of vegetable oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol di stearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes such as paraffin wax, microcrystalline wax and petrolatum, and their derivatives; montanic wax and its derivatives, hydrocarbon waxes obtained by the Fischer-Tropsch method and their derivatives, polyolefin waxes such as polyethylene and polypropylene and their derivatives, natural waxes such as carnauba wax and candelilla wax and their derivatives, higher fatty alcohols, and fatty acids such as stearic acid and palmitic acid, or the mixture of these compounds.

The content of the release agent is preferably from 5.0 to 20.0 mass parts per 100.0 mass parts of the binder resin or polymerizable monomers.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One charge control agent alone or a combination of two or more kinds may be included.

The content of the charge control agent is preferably from 0.01 to 10.00 mass parts per 100.00 mass parts of the binder resin or polymerizable monomers.

The methods for measuring the various physical properties of the toner of the present invention are explained below.

Identification Method of Composite Particle Including Hydrotalcite Particle Covered, on Surface, with Organosilicon Polymer Fine Particle The composite particle including a hydrotalcite particle covered, on the surface, with an organosilicon polymer fine particle can be identified by a combination of shape observation by scanning electron microscopy (SEM) and elemental analysis by energy dispersive X-ray analysis (EDS). More specifically, it can be identified by the methods described below for identifying the organosilicon polymer fine particle and hydrotalcite particle.

Organosilicon Polymer Fine Particle Identification Method

The organosilicon polymer fine particle contained in the toner can be identified by a method combining shape observation by SEM with elemental analysis by EDS.

The toner is observed in a field enlarged to a maximum magnification of 50000× with a scanning electron microscope (trade name: "S-4800", Hitachi, Ltd.). The microscope is focused on the toner particle surface, and the external additive is observed. Each particle of the external additive is subjected to EDS analysis to determine whether or not the analyzed particle is an organosilicon polymer fine particle based on the presence or absence of an Si element peak.

When the toner contains both an organosilicon polymer fine particle and a silica fine particle, the ratio of the elemental contents (atomic %) of Si and O (Si/O ratio) is compared with that of a standard product to identify the organosilicon polymer fine particle.

Standard products of both the organosilicon polymer fine particle and silica fine particle are subjected to EDS analysis under the same conditions, to determine the elemental contents (atomic %) of Si and O.

The Si/O ratio of the organosilicon polymer fine particle is given as A, and the Si/O ratio of the silica fine particle as B. Measurement conditions are selected such that A is significantly larger than B.

Specifically, the standard products are measured 10 times under the same conditions, and arithmetic means are obtained for both A and B. The measurement conditions are selected so that the arithmetic means yield an AB ratio greater than 1.1.

If the Si/O ratio of an evaluated fine particle is closer to A than to [(A+B)/2], the fine particle is judged to be an organosilicon polymer fine particle.

Tospearl 120A (Momentive Performance Materials Japan LLC) is used as the standard product for the organosilicon polymer fine particle, and HDK V15 (Asahi Kasei Corporation) as the standard product for the silica fine particle.

Method for Identifying Compositions and Ratios of Constituent Compounds of Organosilicon Polymer Fine Particle The compositions and ratios of the constituent compounds of the organosilicon polymer fine particle contained in the toner are identified by NMR.

When the toner contains a silica fine particle in addition to the organosilicon polymer fine particle, 1 g of the toner is dissolved and dispersed in 31 g of chloroform in a vial. This is dispersed for 30 minutes with an ultrasound homogenizer to prepare a liquid dispersion.

Ultrasonic processing unit: VP-050 ultrasound homogenizer (Taitec Corporation)

Microchip: Step microchip, tip diameter φ 2 mm

Microchip tip position: Center of glass vial and 5 mm above bottom of vial

Ultrasound conditions: Intensity 30%, 30 minutes

Ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, the glass tube contains silica fine particles with heavy specific gravity in the lower layer. The chloroform solution containing organic silica polymer fine particles in the upper layer is collected, and the chloroform is removed by vacuum drying (40° C./24 hours) to prepare a sample.

Using this sample or the organosilicon polymer fine particles, the abundance ratios of the constituent compounds of the organosilicon polymer fine particle and the ratio of T3 unit structures in the organosilicon polymer fine particle are measured and calculated by solid $^{29}$Si-NMR.

The hydrocarbon group represented by $R^{\alpha}$ above is confirmed by $^{13}$C-NMR.

$^{13}$C-NMR (Solid) Measurement Conditions

Unit: JNM-ECX500II (JEOL RESONANCE Inc.)

Sample tube: 3.2 mm φ

Sample: sample or the organosilicon polymer fine particles

Measurement temperature: Room temperature

Pulse mode: CP/MAS
Measurement nuclear frequency: 123.25 MHz ($^{13}C$)
Standard substance: Adamantane (external standard: 29.5 ppm)
Sample rotation: 20 kHz
Contact time: 2 ms
Delay time: 2 s
Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$O_5H_{11}$), hexyl groups (Si—$C_6H_{13}$) or phenyl groups (Si—$C_6H_5$—) bound to silicon atoms.

In solid $^{29}$Si-NMR, on the other hand, peaks are detected in different shift regions depending on the structures of the functional groups binding to Si in the constituent compounds of the organosilicon polymer fine particle.

The structures binding to Si can be specified by using standard samples to specify each peak position. The abundance ratio of each constituent compound can also be calculated from the resulting peak areas. The ratio of the peak area of T3 unit structures relative to the total peak area can also be determined by calculation.

The measurement conditions for solid $^{29}$Si-NMR are as follows for example.
Unit: JNM-ECX5002 (JEOL RESONANCE Inc.)
Temperature: Room temperature
Measurement method: DDMAS method, $^{29}$Si 45°
Sample tube: Zirconia 3.2 mm φ
Sample: Packed in sample tube in powder form
Sample rotation: 10 kHz
Relaxation delay: 180 s
Scan: 2,000

After this measurement, the peaks of the multiple silane components having different substituents and linking groups in the organosilicon polymer fine particle are separated by curve fitting into the following X1, X2, X3 and X4 structures, and the respective peak areas are calculated.

The X3 structure below is the T3 unit structure according to the present invention.

$X1$ structure: $(Ri)(Rj)(Rk)SiO_{1/2}$ (A1)

$X2$ structure: $(Rg)(Rh)Si(O_{1/2})_2$ (A2)

$X3$ structure: $RmSi(O_{1/2})_3$ (A3)

$X4$ structure: $Si(O_{1/2})_4$ (A4)

X1 structure (A1)

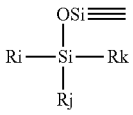

X2 structure (A2)

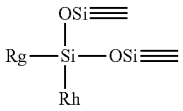

X3 structure

-continued (A3)

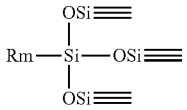

X4 structure (A4)

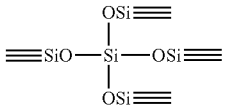

Ri, Rj, Rk, Rg, Rh and Rm in formulae (A1), (A2) and (A3) represent halogen atoms, hydroxyl groups, acetoxy groups, alkoxy groups or organic groups such as $C_{1-6}$ hydrocarbon groups bound to silicon.

When a structure needs to be confirmed in more detail, it can be identified from $^1$H-NMR measurement results in addition to the above $^{13}$C-NMR and $^{29}$Si-NMR measurement results.

Method for Identifying Hydrotalcite Particle

The hydrotalcite particle can be identified by a combination of shape observation by scanning electron microscopy (SEM) and elemental analysis by energy dispersive X-ray analysis (EDS).

The toner is observed in a field enlarged to a maximum magnification of 50,000× with an "S-4800" (trade name) scanning electron microscope (Hitachi, Ltd.). The microscope is focused on the toner particle surface, and the external additive to be distinguished is observed. The external additive to be distinguished is subjected to EDS analysis, and the hydrotalcite particle is identified based on the presence or absence of elemental peaks.

For the elemental peaks, if the elemental peak of at least one metal selected from the group consisting of the metals Mg, Zn, Ca, Ba, Ni, Sr, Cu and Fe that may constitute the hydrotalcite particle and the elemental peak of at least one metal selected from the group consisting of Al, B, Ga, Fe, Co and In are observed, the presence of a hydrotalcite particle containing these two metals can be deduced.

A standard sample of the hydrotalcite particle deduced from EDS analysis is prepared separately, and subjected to EDS analysis and SEM shape observation. A particle to be distinguished can be judged to be a hydrotalcite particle based on whether the analysis results for the standard sample match the analysis results for the particle to be distinguished.

Method for Measuring Coverage Ratio of Hydrotalcite Particle Surface by Organosilicon Polymer Fine Particle in Composite Particle The "coverage ratio of the hydrotalcite particle surface by the organosilicon polymer fine particle" in the composite particle is measured using an "S-4800" (trade name) scanning electron microscope (Hitachi, Ltd.). 100 random composite particles are photographed in a field enlarged to a maximum magnification of 50,000×.

In the photographed images, the area "A" of the regions without adhering organosilicon polymer fine particles and the area "B" of the regions with adhering particles in each composite particle are measured, and the ratio of the area covered by the organosilicon polymer fine particle [B/(A+B)] is calculated. The coverage ratio is measured for 100 composite particles, and the arithmetic mean is given as the coverage ratio.

Method for Measuring Number-Average Particle Diameters of Primary Particles of Organosilicon Polymer Fine Particle and Hydrotalcite Particle This is measured using an "S-4800" (trade name) scanning electron microscope (Hitachi, Ltd.) in combination with elemental analysis by energy dispersive X-ray analysis (EDS).

100 random composite particles are photographed in a field enlarged to a maximum magnification of 50,000×.

100 organosilicon polymer fine particles and hydrotalcite particles are selected randomly from the photographed images, the long diameters of the primary particles are measured, and the calculated averages are given as the number-average particle diameters.

The observation magnification is adjusted appropriately according to the sizes of the organosilicon polymer fine particle and the hydrotalcite particle.

Method for Measuring Number-Average Particle Diameter of Composite Particle

This is measured using an "S-4800" (trade name) scanning electron microscope (Hitachi, Ltd.) in combination with elemental analysis by energy dispersive X-ray analysis (EDS).

The toner containing the composite particle is observed, the long diameters of 100 randomly-selected composite particles are measured in a field enlarged to a maximum magnification of 50,000×, and the calculated average is given as the number-average particle diameter.

The observation magnification is adjusted appropriately according to the size of the composite particles.

Method for Measuring Number Ratio of Composite Particles Relative to Toner Particles The number ratio of composite particles relative to toner particles is measured using an "S-4800" (trade name) scanning electron microscope (Hitachi, Ltd.) in combination with elemental analysis by energy dispersive X-ray analysis (EDS).

The toner containing the composite particle is observed, and 1,000 random fields are photographed at a magnification of 1,000×. The number of composite particles and the number of toner particles in the toner are counted, and the number ratio is calculated.

Method for Measuring Average Circularity of Toner

The average circularity of the toner is measured with an "FPIA-3000" flow particle image analyzer (Sysmex Corporation) under the measurement and analysis conditions for calibration operations.

The specific measurement methods are as follows.

About 20 mL of ion-exchange water from which solid impurities and the like have been removed is first placed in a glass container. About 0.2 mL of a dilute solution of "Contaminon N" (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted about three times by mass with ion-exchange water is then added as a dispersant.

About 0.02 g of the measurement sample is then added and dispersed for 2 minutes with an ultrasonic disperser to obtain a dispersion for measurement. Cooling is performed as appropriate during this process so that the temperature of the dispersion is 10° C. to 40° C.

Using a tabletop ultrasonic cleaner and disperser having an oscillating frequency of 50 kHz and an electrical output of 150 W (for example, "VS-150" manufactured by Velvo-Clear) as an ultrasonic disperser, a predetermined amount of ion-exchange water is placed on the water tank, and about 2 mL of the Contaminon N is added to the tank.

A flow particle image analyzer equipped with a "LUCPLFLN" objective lens (magnification 20×, aperture 0.40) is used for measurement, with particle sheath "PSE-900A" (Sysmex Corporation) as the sheath liquid. The liquid dispersion obtained by the procedures above is introduced into the flow particle image analyzer, and 2,000 toner particles are measured in HPF measurement mode, total count mode.

The average circularity of the toner is then determined with a binarization threshold of 85% during particle analysis, and with the analyzed particle diameters limited to equivalent circle diameters of from 1.977 to less than 39.54 μm.

Prior to the start of measurement, autofocus adjustment is performed using standard latex particles (for example, Duke Scientific Corporation "RESEARCH AND TEST PARTICLES Latex Microsphere Suspensions 5100A" diluted with ion-exchange water). Autofocus adjustment is then performed again every two hours after the start of measurement.

Method for Measuring Weight-Average Particle Diameter (D4) of Toner

The weight-average particle diameter (D4) of the toner is calculated as follows. A "Multisizer 3 Coulter Counter" precise particle size distribution analyzer (registered trademark, Beckman Coulter, Inc.) based on the pore electrical resistance method and equipped with a 100 μm aperture tube is used as the measurement unit together with the accessory dedicated "Beckman Coulter Multisizer 3 Version 3.51" software (Beckman Coulter, Inc.) for setting the measurement conditions and analyzing the measurement data. Measurement is performed with 25,000 effective measurement channels.

The aqueous electrolytic solution used in measurement may be a solution of special grade sodium chloride dissolved in ion-exchanged water to a concentration of about 1 mass %, such as "ISOTON II" (Beckman Coulter, Inc.) for example.

The following settings are performed on the dedicated software prior to measurement and analysis.

On the "Change standard measurement method (SOMME)" screen of the dedicated software, the total count number in control mode is set to 50,000 particles, the number of measurements to 1, and the Kd value to a value obtained with "Standard particles 10.0 μm" (Beckman Coulter, Inc.). The threshold and noise level are set automatically by pushing the "Threshold/noise level measurement" button. The current is set to 1,600 μA, the gain to 2, and the electrolytic solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 to 60 μm.

The specific measurement methods are as follows.

(1) About 200 mL of the aqueous electrolytic solution is placed in a glass 250 mL round-bottomed beaker dedicated to the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a glass 100 mL flat-bottomed beaker, and about 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries, Ltd.) diluted about three times by mass with ion-exchange water is added.

(3) An ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other is prepared. About 3.3 L of ion-exchange water is added to the water tank of the ultrasonic disperser, and about 2 mL of Contaminon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner dispersed therein is dripped with a pipette into the round-bottomed beaker of (1) above set on the sample stand, and adjusted to a measurement concentration of about 5%. Measurement is then performed until the number of measured particles reaches 50,000.

(7) The measurement data is analyzed with the dedicated software included with the apparatus, and the weight-average particle diameter (D4) is calculated. The weight-average particle diameter (D4) is the "Average diameter" on the "Analysis/volume statistical value (arithmetic mean)" screen when graph/volume % is set in the dedicated software.

EXAMPLES

The invention is explained in more detail below based on examples and comparative examples, hut the invention is in no way limited to these. Unless otherwise specified, parts in the examples are based on mass.

Toner manufacturing examples are explained.

Preparation of Binder Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed in this mixed solution.

This was then gently stirred for 10 minutes as an aqueous solution of 0.3 parts of potassium persulfate mixed with 10 parts of ion-exchange water was added.

After nitrogen purging, emulsion polymerization was performed for 6 hours at 70° C. After completion of polymerization, the reaction solution was cooled to room temperature, and ion-exchange water was added to obtain a binder resin particle dispersion with a volume-based median particle diameter of 0.2 μm and a solids concentration of 12.5 mass %.

Preparation of Release Agent Dispersion 100 parts of a release agent (behenyl behenate, melting point: 72.1° C.) and 15 parts of Neogen RK were mixed with 385 parts of ion-exchange water, and dispersed for about 1 hour with a JN100 wet jet mill (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" and 15 parts of Neogen RK were mixed with 885 parts of ion-exchange water, and dispersed for about 1 hour in a JN100 wet jet mill to obtain a colorant dispersion.

Preparation of Toner Particle 1

265 parts of the binder resin particle dispersion, 10 parts of the release agent dispersion and 10 parts of the colorant dispersion were dispersed with a homogenizer (IKA Japan K.K.: Ultra-Turrax T50).

The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles. The particle diameter of the aggregate particles was measured under these conditions with a "Multisizer 3 Coulter Counter" (registered trademark, Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake.

This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to perform final solid-liquid separation and obtain a toner cake.

The resulting toner cake was dried with a Flash Jet air dryer (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. The toner particle 1 had a weight-average particle diameter (D4) of 6.3 μm, an average circularity of 0.980, and a glass transition temperature (Tg) of 57° C.

Manufacturing Example of Organosilicon Polymer Fine Particle A1

Step 1

360.0 parts of water were placed in a reactor equipped with a thermometer and a stirrer, and 15.0 parts of 5.0 mass % hydrochloric acid were added to obtain a uniform solution. This was stirred at 25° C. as 136.0 parts of methyl trimethoxysilane were added and stirred for 5 hours, after which the mixture was filtered to obtain a clear reaction solution containing a silanol compound or a partial condensate thereof.

Step 2

440.0 parts of water were placed in a reactor equipped with a thermometer, a stirrer and a dripping mechanism, and 17.0 parts of 10.0 mass % ammonia water were added to obtain a uniform solution.

This was stirred at 35° C. as 100.0 parts of the reaction solution obtained in Step 1 were dripped in over the course of 0.5 hours, and then stirred for 6 hours to obtain a suspension.

The resulting suspension was centrifuged to precipitate the particles, which were then removed and dried for 24 hours in a drier at 200° C. to obtain an organosilicon polymer fine particle A1.

The number-average particle diameter of the primary particles of the resulting organosilicon polymer fine particle A1 was 100 nm.

External Additive A: Manufacturing Examples of Organosilicon Polymer Fine Particles A2 to A7

Organosilicon polymer fine particles A2 to A7 were obtained as in the manufacturing example of the organosilicon polymer fine particle A1 except that the silane compound, reaction initiation temperature, added amount of ammonia water and reaction solution dripping time were changed as shown in Table 1. The physical properties of the resulting organosilicon polymer fine particles A2 to A7 are shown in Table 1.

TABLE 1

| Organo-silicon polymer fine particle No. | Step 1 Water Parts | Hydrochloric acid Parts | Reaction temperature ° C. | Silane compound A Name | Silane compound A Parts | Silane compound B Name | Silane compound B Parts | Silane compound C Name | Silane compound C Parts |
|---|---|---|---|---|---|---|---|---|---|
| A1 | 360.0 | 15.0 | 25 | MTMS | 136.0 | — | — | — | — |
| A2 | 360.0 | 8.0 | 25 | PTMS | 190.1 | TPMS | 5.0 | — | — |
| A3 | 360.0 | 23.0 | 25 | MTMS | 136.0 | — | — | — | — |
| A4 | 360.0 | 15.0 | 25 | MTMS | 122.4 | TMMS | 10.4 | — | — |
| A5 | 360.0 | 13.0 | 25 | MTMS | 122.4 | TMMS | 10.4 | TMS | 7.6 |
| A6 | 360.0 | 13.0 | 25 | MTMS | 136.0 | — | — | — | — |
| A7 | 360.0 | 20.0 | 25 | MTMS | 136.0 | — | — | — | — |

| Organo-silicon polymer fine particle No. | Step 2 Reaction solution obtained in Step 1 Parts | Water Parts | Ammonia water Parts | Reaction initiation temperature ° C. | Dripping time hours | Number-average particle diameter of primary particles [nm] | T |
|---|---|---|---|---|---|---|---|
| A1 | 100 | 440 | 17.0 | 35 | 0.50 | 100 | 1.00 |
| A2 | 100 | 440 | 10.0 | 40 | 2.00 | 20 | 0.98 |
| A3 | 100 | 500 | 23.0 | 30 | 0.17 | 350 | 1.00 |
| A4 | 100 | 460 | 17.0 | 35 | 0.50 | 100 | 0.90 |
| A5 | 100 | 440 | 17.0 | 35 | 0.50 | 100 | 0.88 |
| A6 | 100 | 440 | 15.0 | 40 | 1.00 | 50 | 1.00 |
| A7 | 100 | 440 | 21.0 | 30 | 0.25 | 250 | 1.00 |

In the table,

MTMS represents "Methyl trimethoxysilane",

PTMS represents "Pentyl trimethoxysilane",

TPMS represents "Tripentyl methoxysilane",

TMMS represents "Trimethyl methoxysilane",

TMS represents "Tetramethoxysilane", and

T represents the ratio of the area of peaks derived from silicon having a T3 unit structure to the total area of peaks derived from all silicon element contained in the organosilicon polymer fine particles.

Manufacturing Examples of Hydrotalcite Particles 1 to 5

Hydrotalcite particles 1 to 5 were prepared by the methods described in Japanese Patent Nos. 1198372 and 5911153.

A hydrotalcite particle 1 was manufactured as follows.

A mixed aqueous solution (solution A) containing 1.03 mol/L of magnesium chloride and 0.239 mol/L of aluminum sulfate, a 0.753 mol/L sodium carbonate aqueous solution (solution B) and a 3.39 mol/L sodium hydroxide aqueous solution (solution C) were prepared.

Using a metering pump the A, B and C solutions were injected into the reaction tank at a flow rate that yielded a volume ratio of (A solution):(B solution) of 4.5:1, the pH of the reaction solution was adjusted to range of 9.3 to 9.6 with the C solution, and the mixture was reacted at a reaction temperature of 40° C. to produce a precipitate. This was filtered, washed, and re-emulsified with ion-exchange water to obtain a hydrotalcite slurry of the raw materials. The hydrotalcite concentration of the resulting hydrotalcite slurry was 5.6 mass %.

The resulting hydrotalcite slurry was vacuum dried overnight at 40° C., after which 3 mass % of a higher fatty acid (stearic acid) was added to perform surface treatment.

The hydrotalcite particles 2 to 5 were obtained as in the manufacturing example of the hydrotalcite particle 1 except that the ratio of the A solution to the B solution (A:B) was adjusted appropriately.

The compositions and physical properties of the resulting hydrotalcite particles 1 to 5 are shown in Table 2.

TABLE 2

| Hydrotalcite particle No. | Composition | Number-average particle diameter of primary particles (nm) |
|---|---|---|
| 1 | $Mg_{4.3}Al_2(OH)_{12.6}CO \cdot mH_2O$ | 400 |
| 2 | $Mg_{4.3}Al_2(OH)_{12.6}CO_3 \cdot mH_2O$ | 1000 |
| 3 | $Mg_{4.3}Al_2(OH)_{12.6}CO_3 \cdot mH_2O$ | 700 |
| 4 | $Mg_6Al_2(OH)_{16}CO_3 \cdot mH_2O$ | 60 |
| 5 | $Mg_{4.3}Al_2(OH)_{12.6}CO_3 \cdot mH_2O$ | 2000 |

Manufacturing Example of Composite Particle 1

The organosilicon polymer fine particle A1 and the hydrotalcite particle 1 were mixed in the ratios shown in Table 3 in a 500 mL glass container, and then mixed for 1 minute with a blender mixer (Oster) at an output of 450 W to obtain a composite particle 1.

Manufacturing Examples of Composite Particles 2 to 23

Composite particles 2 to 23 were obtained as in the manufacturing example of the composite particle 1 except that the conditions were changed as shown in Table 3.

Manufacturing Example of Composite Particle 24

The composite particle 24 was obtained as in the manufacturing example of the composite particle 1 except that 10 parts of a sol-gel silica with a number average particle diameter of 110 nm (X24-9600A: Shin-Etsu Chemical Co., Ltd.) were used instead of the 6 parts of the organosilicon polymer fine particle A1.

Manufacturing Example of Composite Particle 25

A composite particle 25 was obtained as in the manufacturing example of the composite particle 17 except that the mixing conditions were changed to 3 minutes at 450 W.

TABLE 3

| | Organosilicon polymer fine particle | | | Hydrotalcite particle | | |
|---|---|---|---|---|---|---|
| Composite particle No. | Type | Particle diameter (nm) | Parts | Type | Particle diameter (nm) | Parts |
| 1 | A1 | 100 | 6.0 | 1 | 400 | 100.0 |
| 2 | A1 | 100 | 1.0 | 1 | 400 | 100.0 |
| 3 | A1 | 100 | 2.5 | 1 | 400 | 100.0 |
| 4 | A1 | 100 | 10.0 | 1 | 400 | 100.0 |
| 5 | A1 | 100 | 15.0 | 1 | 400 | 100.0 |
| 6 | A2 | 20 | 0.1 | 1 | 400 | 100.0 |
| 7 | A2 | 20 | 2.0 | 1 | 400 | 100.0 |
| 8 | A2 | 20 | 3.0 | 1 | 400 | 100.0 |
| 9 | A3 | 350 | 2.0 | 2 | 1000 | 100.0 |
| 10 | A3 | 350 | 13.0 | 2 | 1000 | 100.0 |
| 11 | A3 | 350 | 18.0 | 2 | 1000 | 100.0 |
| 12 | A4 | 100 | 10.0 | 1 | 400 | 100.0 |
| 13 | A5 | 100 | 8.0 | 1 | 400 | 100.0 |
| 14 | A6 | 50 | 5.0 | 1 | 400 | 100.0 |
| 15 | A7 | 250 | 15.0 | 3 | 700 | 100.0 |
| 16 | A3 | 350 | 18.0 | 3 | 700 | 100.0 |
| 17 | A2 | 20 | 10.0 | 4 | 60 | 100.0 |
| 18 | A1 | 100 | 2.0 | 5 | 2000 | 100.0 |
| 19 | A1 | 100 | 6.0 | 1 | 400 | 100.0 |
| 20 | A1 | 100 | 6.0 | 1 | 400 | 100.0 |
| 21 | A1 | 100 | 6.0 | 1 | 400 | 100.0 |

TABLE 3-continued

| | Organosilicon polymer fine particle | | | Hydrotalcite particle | | |
|---|---|---|---|---|---|---|
| Composite particle No. | Type | Particle diameter (nm) | Parts | Type | Particle diameter (nm) | Parts |
| 22 | A1 | 100 | 15.0 | 1 | 400 | 100.0 |
| 23 | A3 | 350 | 260.0 | 4 | 60 | 100.0 |

Manufacturing Example of Toner 1

External Addition Step 0.20 parts of the composite particle 1 and 1.00 part of a hydrophobic silica fine particle [shown as C1 in tables, BET specific surface area 150 $m^2/g$, hydrophobically treated with 30 parts of hexamethyl disilazane (HMDS) and 10 parts of dimethyl silicone oil per 100 parts of the silica fine particle] were added to 100.00 parts of the toner particle 1 obtained above in an FM mixer (Nippon Coke & Engineering Co., Ltd. FM10C) with 7° C. water in the jacket.

Once the water temperature in the jacket had stabilized at 7° C.±1° C., this was mixed for 5 minutes with a 38 m/sec peripheral speed of the rotating blade, to obtain a toner mixture 1. The amount of water passing through the jacket was adjusted appropriately during this process so that the temperature in the FM mixer tank did not exceed 25° C.

The resulting toner mixture 1 was sieved with a 75 μm mesh sieve to obtain a toner 1.

The manufacturing conditions and physical properties of the toner are shown in Table 4. The coverage ratio of the hydrotalcite particle surface by the organosilicon polymer fine particle in the composite particle, the number-average particle diameter of the composite particle, and the number ratio of the composite particle relative to the toner particle were measured in the resulting toner. The results are shown in Table 4.

Preparation Examples of Toners 2 to 22 and Comparative Toners 1 to 6

Toners 2 to 22 and comparative toners 1 to 6 were obtained as in the manufacturing example of the toner 1 except that the conditions were changed as shown in Table 4. The physical properties of the toners 2 to 22 and comparative toners 1 to 6 are shown in Table 4.

TABLE 4

| | Toner | External addition conditions | | | | | | Physical properties of composite particle | | |
|---|---|---|---|---|---|---|---|---|---|---|
| | | | | | | | | X | Y | |
| | No. | Additive 1 | Parts | Additive 2 | Parts | Additive 3 | Parts | (%) | (nm) | Z |
| Example 1 | 1 | CP 1 | 0.20 | C1 | 1.00 | — | — | 25 | 470 | 0.010 |
| Example 2 | 2 | CP 2 | 0.20 | C1 | 1.00 | — | — | 3 | 410 | 0.010 |
| Example 3 | 3 | CP 3 | 0.20 | C1 | 1.00 | — | — | 10 | 430 | 0.010 |
| Example 4 | 4 | CP 4 | 0.20 | C1 | 1.00 | — | — | 32 | 470 | 0.010 |
| Example 5 | 5 | CP 5 | 0.20 | C1 | 1.00 | — | — | 50 | 510 | 0.010 |
| Example 6 | 6 | CP 6 | 0.20 | C1 | 1.00 | — | — | 1 | 380 | 0.010 |
| Example 7 | 7 | CP 7 | 0.20 | C1 | 1.00 | — | — | 30 | 430 | 0.010 |
| Example 8 | 8 | CP 8 | 0.20 | C1 | 1.00 | — | — | 45 | 460 | 0.010 |
| Example 9 | 9 | CP 9 | 0.40 | C1 | 1.00 | — | — | 5 | 1000 | 0.010 |
| Example 10 | 10 | CP 10 | 0.40 | C1 | 1.00 | — | — | 34 | 1150 | 0.010 |
| Example 11 | 11 | CP 11 | 0.40 | C1 | 1.00 | — | — | 46 | 1220 | 0.010 |
| Example 12 | 12 | CP 12 | 0.20 | C1 | 1.00 | — | — | 35 | 430 | 0.010 |
| Example 13 | 13 | CP 13 | 0.20 | C1 | 1.00 | — | — | 32 | 450 | 0.010 |
| Example 14 | 14 | CP 14 | 0.20 | C1 | 1.00 | — | — | 31 | 410 | 0.010 |
| Example 15 | 15 | CP 15 | 0.30 | C1 | 1.00 | — | — | 35 | 780 | 0.010 |
| Example 16 | 16 | CP 16 | 0.30 | C1 | 1.00 | — | — | 32 | 820 | 0.010 |
| Example 17 | 17 | CP 17 | 0.03 | C1 | 1.00 | — | — | 32 | 70 | 0.010 |
| Example 18 | 18 | CP 18 | 0.50 | C1 | 1.00 | — | — | 28 | 2110 | 0.010 |
| Example 19 | 19 | CP 19 | 0.20 | C1 | 1.00 | — | — | 25 | 410 | 0.005 |

TABLE 4-continued

| | Toner | External addition conditions | | | | | | Physical properties of composite particle | | |
|---|---|---|---|---|---|---|---|---|---|---|
| | | | | | | | | X | Y | |
| | No. | Additive 1 | Parts | Additive 2 | Parts | Additive 3 | Parts | (%) | (nm) | Z |
| Example 20 | 20 | CP 20 | 0.02 | C1 | 1.00 | — | — | 25 | 380 | 0.001 |
| Example 21 | 21 | CP 21 | 1.00 | C1 | 1.00 | — | — | 25 | 420 | 0.100 |
| Example 22 | 22 | CP 25 | 1.00 | C1 | 1.00 | — | — | 38 | 70 | 0.900 |
| Comparative Example 1 | Comparative 1 | CP 22 | 0.20 | C1 | 1.00 | — | — | 60 | 430 | 0.010 |
| Comparative Example 2 | Comparative 2 | CP 23 | 0.20 | C1 | 1.00 | — | — | 80 | 510 | 0.010 |
| Comparative Example 3 | Comparative 3 | CP 24 | 0.20 | C1 | 1.00 | — | — | 30 | 450 | 0.010 |
| Comparative Example 4 | Comparative 4 | Hydrotalcite particle 1 | 0.20 | C1 | 1.00 | — | — | — | — | 0.000 |
| Comparative Example 5 | Comparative 5 | Organosilicon polymer fine particle A1 | 0.01 | C1 | 1.00 | — | — | — | — | 0.000 |
| Comparative Example 6 | Comparative 6 | Organosilicon polymer fine particle A3 | 0.04 | Hydrotalcite particle 3 | 0.20 | C1 | 1.00 | — | — | 0.000 |

In the table,

CP represents "Composite particle",

X represents the coverage ratio of the hydrotalcite particle surface by the organosilicon polymer fine particle, Y represents the number-average particle diameter of the composite particle, and Z represents the number ratio of composite particle relative to the toner particle.

Example 1

The toner 1 was evaluated as follows. The evaluation results are shown in Table 5.

A modified LBP712Ci (Canon Inc.) was used as the evaluation unit. The process speed of the main unit was modified to 300 mm/sec, and the necessary adjustments were made so that image formation was possible under these conditions. The toner was removed from a black cartridge, which was then filled with 300 g of the toner 1. The photosensitive member was also removed from the cartridge, and replaced with a photosensitive member with a protective layer formed on the surface. Using a photosensitive member with a protective layer, it is easier to evaluate the effects of image smearing from discharge products because the surface layer of the photosensitive member is resistant to scratching.

Image Evaluation

Image Smearing Evaluation

Image smearing was evaluated by the following methods in a high-temperature, high-humidity environment (30° C./80% RH).

Canon Color Laser Copier paper (A4: 81.4 g/m$^2$, used here and below unless otherwise specified) was used as the evaluation paper.

10,000 sheets were output continuously per day at a print percentage of 1%, and then left in the machine for one day, after which the presence or absence of image smearing was compared. One sheet of a halftone image was output and evaluated as the image sample. An evaluation was performed every 10,000 sheets, and evaluation was performed continuously up to 30,000 sheets. The evaluation standard is as follows.

Evaluation Standard

A: No white spots or contour blurring at the image boundary due to latent image lead B: Slight contour blurring at the image boundary due to latent image lead on part of the image C: White spots and contour blurring at the image boundary due to latent image lead on part of the image D: White spots and contour blurring at the image boundary due to latent image lead on the entire image Evaluation of Black Spots Black spot images are black spots 1 to 2 mm in size that occur when the latent image bearing member (photosensitive body) is contaminated by an external additive, and this image defect is easily observed when a halftone image is output. Black spot images were evaluated by the following methods.

The cartridge used in the above 30,000-sheet test for evaluating image smearing was left standing for one day in a low-temperature, low-humidity environment (15° C./10% RH), and used in the evaluation. Using the cartridge that was left standing, a half-tone image was output in a low-temperature, low-humidity environment, and the presence or absence of black spots was observed. The evaluation standard was as follows.

Evaluation Standard

A: No problems on image, no melt adhering material observed on photosensitive member under microscope B: No problems on image, slight melt adhering material observed on photosensitive member under microscope C: Slight black spot image observed on part of image, slight melt adhering material observed on photosensitive member under microscope D: Black spot image of photosensitive member cycle confirmed on image, melt adhering material observed with the naked eye on photosensitive member Solid Followability Evaluation Solid followability in low-temperature, low-humidity environments was evaluated by the following methods. 10,000 sheets were output continuously per day at a print percentage of 1% on the above Canon Color Laser Copier paper in a low-temperature, low-humidity environment (15° C./10% RH), and then left in the machine for one day, after which solid followability was evaluated.

Three sheets of an all-black image as a sample image were then output continuously, and the third sheet resulting all-black images were evaluated with the naked eye to evaluate solid followability. The evaluation standard is shown below.

This evaluation is known to yield better results the greater the flowability of the toner. An evaluation was performed after every 10,000 sheets, and evaluation was performed continuously up to 30,000 sheets.

Evaluation Standard

A: Uniform image density without irregularities

B: Some slight irregularities in image density, but at a level that is not a problem for use C: Some irregularities in image density, but at a level that is not a problem for use D: Irregularities in image density, uniform solid image not obtained Examples 2 to 22, Comparative Examples 1 to 6

The toners 2 to 22 and comparative toners 1 to 6 were evaluated as in the Example 1.

The evaluation results are shown in Table 5.

TABLE 5

| | | Image smearing | | | Black spots | Solid followability | | |
|---|---|---|---|---|---|---|---|---|
| | Toner No. | After 10,000 sheets | After 20,000 sheets | After 30,000 sheets | After 30,000 sheets | After 10,000 sheets | After 20,000 sheets | After 30,000 sheets |
| Example 1 | 1 | A | A | A | A | A | B | B |
| Example 2 | 2 | A | A | A | C | A | B | B |
| Example 3 | 3 | A | A | A | B | A | B | B |
| Example 4 | 4 | A | A | A | A | A | B | B |
| Example 5 | 5 | A | B | C | A | A | B | B |
| Example 6 | 6 | A | A | A | C | A | B | B |
| Example 7 | 7 | A | A | A | B | A | B | B |
| Example 8 | 8 | A | B | C | B | A | B | B |
| Example 9 | 9 | A | A | A | C | A | B | C |
| Example 10 | 10 | A | A | A | A | A | B | C |
| Example 11 | 11 | A | B | C | A | A | B | C |
| Example 12 | 12 | A | A | A | A | A | B | C |
| Example 13 | 13 | A | A | A | A | A | B | C |
| Example 14 | 14 | A | A | A | A | A | B | B |
| Example 15 | 15 | A | A | A | A | A | B | B |
| Example 16 | 16 | A | A | A | A | A | B | C |
| Example 17 | 17 | A | A | A | C | A | B | B |
| Example 18 | 18 | A | A | A | A | C | C | C |
| Example 19 | 19 | A | A | B | A | A | B | B |
| Example 20 | 20 | A | A | B | A | A | B | B |
| Example 21 | 21 | A | A | A | A | A | B | B |
| Example 22 | 22 | A | A | A | C | A | B | B |
| Comparative Example 1 | Comparative 1 | C | D | D | A | A | B | B |
| Comparative Example 2 | Comparative 2 | C | D | D | D | B | C | C |
| Comparative Example 3 | Comparative 3 | B | C | C | D | B | C | C |
| Comparative Example 4 | Comparative 4 | B | C | C | D | B | C | C |
| Comparative Example 5 | Comparative 5 | C | D | D | A | A | B | B |
| Comparative Example 6 | Comparative 6 | B | C | C | D | C | D | D |

In Examples 1 to 22, good results were obtained in all evaluations. In Comparative Examples 1 to 6, on the other hand, the results were inferior to those of the examples in some evaluations.

These results show that the present invention provides a toner with good flowability whereby image smearing and melt adhesion of the external additive to the latent image bearing member are suppressed even during long-term use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247079, filed Dec. 28, 2018, which is hereby incorporated by reference herein in its entirety.

What is claimed is:

1. A toner comprising:

a toner particle and an external additive, wherein the external additive includes a composite particle including a hydrotalcite particle covered, on a surface, with an organosilicon polymer fine particle, a coverage ratio of the hydrotalcite particle surface by the organosilicon polymer fine particle is from 1% to 50%, and given A nm as the number-average particle diameter of the primary particles of the organosilicon polymer fine particle and B nm as the number-average particle diameter of the primary particles of the hydrotalcite particle, the toner satisfies the following formula (I) and formula (II):

$$A<B \quad \text{(I)}$$

$$20 \leq A \leq 350 \quad \text{(II)}.$$

2. The toner according to claim 1, wherein the B is from 60 to 1,000.

3. The toner according to claim 1, wherein the A is from 20 to 300.

4. The toner according to claim 1, wherein the organosilicon polymer fine particle has a structure of alternately binding silicon atoms and oxygen atoms, and part of the organosilicon polymer has a T3 unit structure represented by $R^{a}SiO_{3/2}$, wherein $R^{a}$ represents a $C_{1-6}$ alkyl group or phenyl group.

5. The toner according to claim 4, wherein in $^{29}$Si-NMR measurement of the organosilicon polymer fine particle, a ratio of an area of a peak derived from silicon having the T3 unit structure relative to the total area of peaks derived from all silicon elements contained in the organosilicon polymer fine particle is from 0.50 to 1.00.

6. The toner according to claim 1, wherein a number ratio of the composite particle relative to the toner particle is from 0.001 to 1.000.

* * * * *